US007030348B1

(12) United States Patent
Kim

(10) Patent No.: US 7,030,348 B1
(45) Date of Patent: Apr. 18, 2006

(54) LIFTING DEVICE FOR MICROWAVE OVEN

(75) Inventor: Seog Tae Kim, Changwon (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 11/019,258

(22) Filed: Dec. 23, 2004

(51) Int. Cl.
*H05B 6/80* (2006.01)

(52) U.S. Cl. ..... 219/756; 126/21 A; 126/273 A; 99/447; 219/757

(58) Field of Classification Search ..... 219/756, 219/702, 762, 739, 751, 758, 757, 763; 126/21 A, 126/273 A, 299 D, 299 R, 37 B, 39 BA, 126/275 E, 198, 213, 339, 211; 248/282.1, 248/415; 99/349, 372, 413, 444, 447, 446
See application file for complete search history.

(56) References Cited

U.S. PATENT DOCUMENTS

| | | | | |
|---|---|---|---|---|
| 4,540,146 | A * | 9/1985 | Basile | 248/201 |
| 6,737,622 | B1 * | 5/2004 | Jeong et al. | 219/756 |
| 2001/0045430 | A1 * | 11/2001 | Mawoud | 219/756 |

FOREIGN PATENT DOCUMENTS

| | | |
|---|---|---|
| JP | 05-040709 | 6/1993 |

* cited by examiner

*Primary Examiner*—Quang Van
(74) *Attorney, Agent, or Firm*—McKenna Long & Aldridge LLP

(57) ABSTRACT

The present invention relates to a lifting device for lifting a microwave oven installed at a position right below kitchen furniture. According to the present invention, an end of a cord 30 is fixed in the microwave oven 20. Further, the cord 30 sequentially passes through a hole 23 formed in a top plate 22 of the microwave oven 20 and a through-hole 14 formed in a bottom plate 12 of the kitchen furniture 10. A stopper 40 or 50 with a center hole 42*a* or 52*a* formed therethrough is installed in the through-hole 14 of the kitchen furniture 10. That is, the cord 30 passes through the bottom plate 12 of the kitchen furniture 10 via the center hole 42*a* or 52*a* of the stopper 40 or 50. At this time, the stopper 40 or 50 limits a one-way motion of the cord 30 through the center hole 42*a* or 52*a*. According to the present invention, there is an advantage in that the microwave oven 20 can be very conveniently installed since the microwave oven 20 can be easily lifted to the position right below the kitchen furniture 10 by using the cord 30 and the stopper 40 or 50.

9 Claims, 6 Drawing Sheets

LIFTING DEVICE FOR MICROWAVE OVEN

BACKGROUND OF THE INVENTION

1. Field of Invention

The present invention relates to a microwave oven, and more particularly, to a lifting device for a microwave oven capable of easily lifting upwardly a combination hood and microwave oven installed on a wall surface adjacent to a lower portion of kitchen furniture.

2. Description of the Prior Art

In general, a combination hood and microwave oven (hereinafter, referred simply to as "a microwave oven") is a microwave oven that is installed at an upper portion of a gas cooking stove to allow heat, fumes and the like generated from the gas cooking stove to be discharged to the outside. Such a microwave oven is generally installed on a wall surface located at position corresponding to a lower portion of kitchen furniture, and its installation process is also illustrated in FIG. 1.

As shown in the figure, a microwave oven 1 is generally installed on a wall surface 5 located at a position adjacent to a bottom plate of the kitchen furniture 3. The microwave oven 1 is fixed and supported on the bottom plate of the kitchen furniture using long screws in a state where its rear surface is engaged with and supported by a mounting plate (not shown) previously fixed on the wall surface 5. That is, the microwave oven 1 can be firmly supported on the bottom plate of the kitchen furniture by fastening a top plate of the microwave oven 1 to the bottom plate of the kitchen furniture 3 using additional screws in a state where it is hanging on the mounting plate.

However, there are the following problems in the related art.

As described above, in order to fasten the microwave oven 1 to the mounting plate installed on the wall surface 5 located at a position right below the kitchen furniture 3, the microwave oven 1 should be lifted to a predetermined position. Further, the microwave oven 1 is relatively heavy. In order to accurately lift the microwave oven 1 to the predetermined position, therefore, two persons generally lift the microwave oven 1 as shown in FIG. 1.

Accordingly, there is a problem in the related art that the working efficiency is lowered since two or more persons are needed to fasten the microwave oven 1 to the wall surface.

In addition, there is another problem in the related art that if the microwave oven is dropped due to carelessness or fatigue of the working persons upon its installation, the microwave oven 1 and the gas cooking stove installed below the microwave oven may be damaged.

SUMMARY OF THE INVENTION

Accordingly, the present invention is conceived to solve the aforementioned problems in the related art. An object of the present invention is to provide a lifting device for a microwave oven capable of easily lifting a microwave oven to a predetermined position.

According to the present invention for achieving the objectives, there is provided a device for lifting a microwave oven installed at a position right below kitchen furniture. The lifting device comprises a cord which has an end fixed in a microwave oven and extends outwardly from the microwave oven through a hole formed in any one of external plates of the microwave oven, and a stopper which is installed in a through-hole formed in a bottom plate of the kitchen furniture to limit a one-way motion of the cord passing through the stopper when the cord has passed through the through-hole.

The cord may be uneven on an outer periphery thereof to increase a contact area with the stopper.

Preferably, the cord is a rope.

The cord may be inserted in a hole formed in a top plate of the microwave oven and an lower end of the cord may be attached to a holder having an area relatively larger than the hole such that the microwave oven can be lifted up by causing the holder to be supported on a bottom surface of the top plate.

Preferably, the stopper includes a stopper body which is inserted in the through-hole and formed with a center hole through which the cord can pass, and a catching piece which extends upwardly from the stopper body to narrow toward a central axis of the center hole such that the catching piece is caught in the outer periphery of the cord to limit the downward motion of the cord.

The stopper may further include support portions which are provided on the stopper body to bring the stopper body into close contact with the bottom plate of the kitchen furniture. Preferably, the stopper include a stopper body which is inserted in the through-hole and is formed with a center hole through which the cord can pass and an internal space which is defined at and expanded at a predetermined position in a radial direction; a plurality of balls which are disposed around the cord within the internal space; and an inclined surface which is defined in a lower portion of the internal space to be inclined downwardly toward the center of the center hole. In such a case, a friction force is generated between the cord and the balls when the cord is moved downwardly, and downward motions of the balls is limited by means of the cord and the inclined surface such that the downward motion of the cord is limited with respect to the stopper.

The stopper may further include support portions which are provided on the stopper body to bring the stopper body into close contact with the bottom plate of the kitchen furniture.

According to another aspect of the present invention, there is provided a lifting device for a microwave oven installed at a position right below kitchen furniture. The lifting device comprises a rope which has an end fixed in a microwave oven and extends outwardly from the microwave oven through a hole formed in an external top plate of the microwave oven, and a stopper which is installed in a through-hole formed in a bottom plate of the kitchen furniture and formed with a center hole, through which the rope passes, to allow the rope to be lifted upwardly but to limit a downward motion of the rope when the rope has passed through the center hole.

According to the present invention so configured, there is an advantage in that the microwave oven can be very conveniently installed since the microwave oven can be easily lifted to a position right below the kitchen furniture by using the cord and stopper structure of the present invention.

BRIEF DESCRIPTION OF THE DRAWINGS

The above and other object, features and advantages of the present invention will become apparent from the following description of preferred embodiments given in conjunction with the accompanying drawings, in which.

DETAILED DESCRIPTION OF THE PREFERRED EMBODIMENT

Hereinafter, the present invention will be described in detail in connection with a first embodiment thereof shown in the accompanying drawings.

Figure 1:
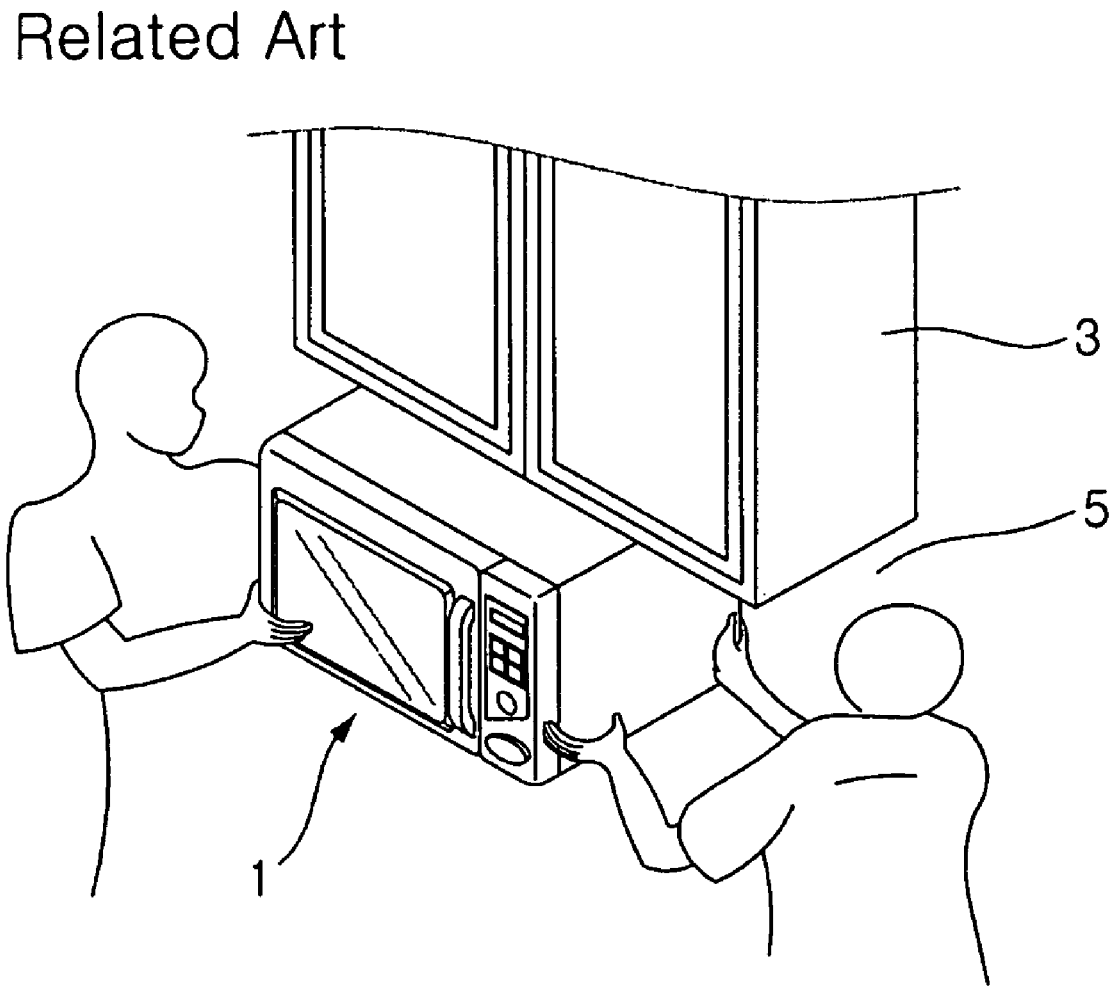
FIG. 1 is a view illustrating how to mount a microwave oven to kitchen furniture according to a related art.
Figure 2:
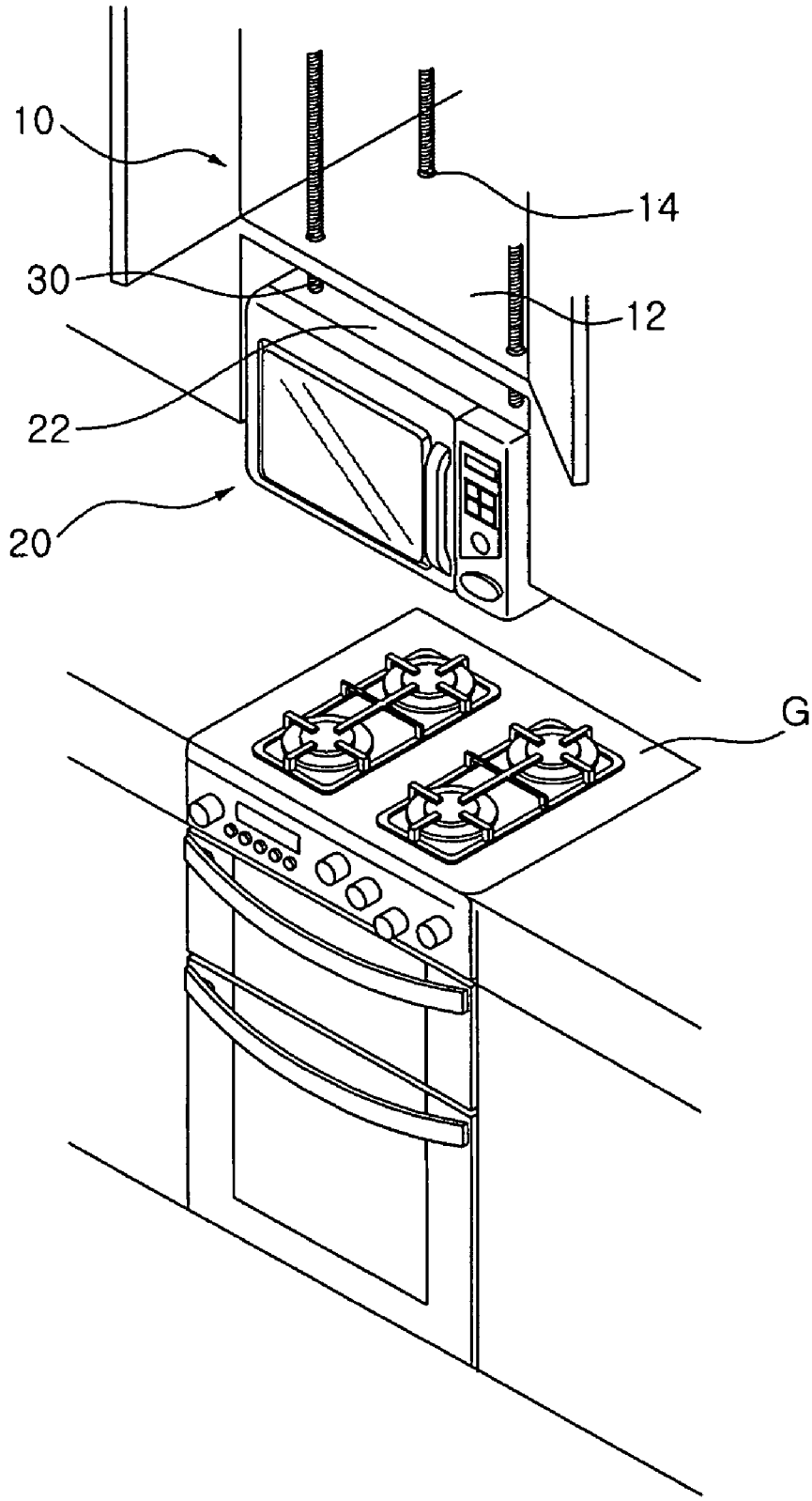
FIG. 2 is a perspective view showing the configuration of a preferred embodiment of a lifting device for a microwave oven according to the present invention.

Referring first to FIG. 2, a microwave oven 20 is installed on a wall surface (not shown) located at a position right below the kitchen furniture 10. According to the present invention, at least a cord 30 is provided on a top plate 22 of the microwave oven 20. The microwave oven 20 may be lift up with a single cord 30 or a plurality of cord 30. However, it is preferred that the cord 30 be provided on each corner of the top plate 22 of the rectangular microwave oven 20.

Figure 7:
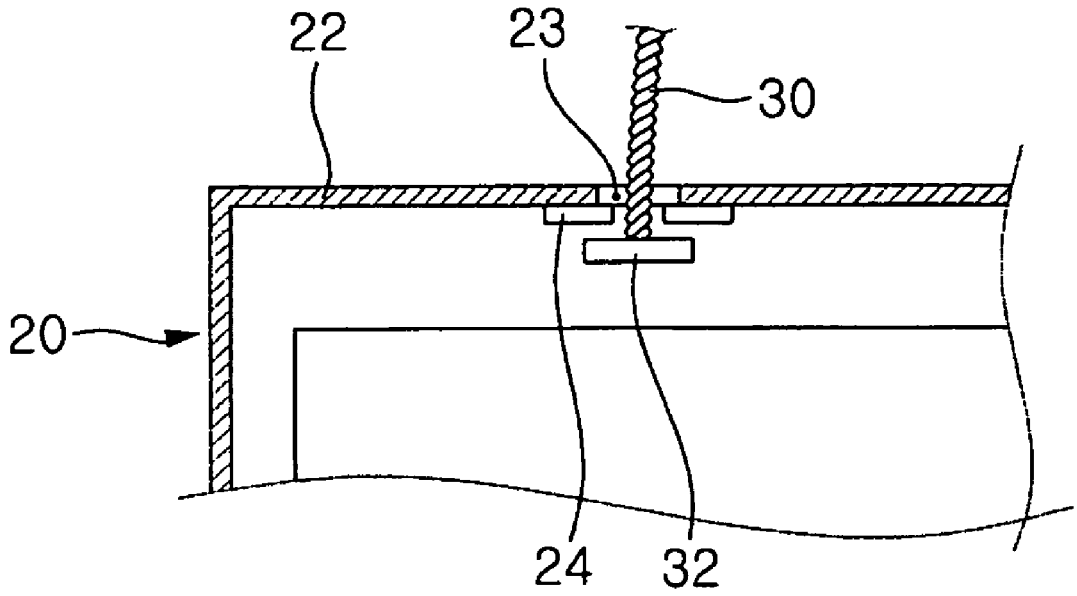
FIG. 7 is a sectional view showing an example of a rope-fixing structure according to the present invention.

The cords 30 are fixed in the microwave oven 20. In such a case, a method in which the cords 30 are fixed is not limited to a specific one, but the cords 30 should not be fixed to the interior parts installed within the microwave oven 20. A suitable method of fixing the cords 30 to the microwave oven 20 is illustrated in FIG. 7 by way of example, but more detailed descriptions thereof will be explained later at a relevant portion in the specification of the present invention.

In addition, the cord 30 should have a friction force enough not to slip out of a stopper 40, which will be explained later, such that the cord can be caught in the stopper 40 to be kept at a fixed state. To this end, it is preferred that the cord 30 be made of a material with a large friction coefficient against the stopper 40 or be uneven on an outer periphery thereof to relatively increase a contact area with the stopper 40. Furthermore, the cord 30 is used to lift up the microwave oven 20 and preferably made of a material capable of withstanding the weight of the microwave oven 20. In this preferred embodiment, such a cord 30 is illustrated as a rope.

A detailed description on a material of a rope illustrated in this embodiment will be omitted herein. The reason is that the cord 30 is not only a general rope well known to those skilled in the art but also can be made of any material so long as it can have a given friction coefficient and strength.

As shown in FIG. 2, a gas cooking stove G may be installed below the microwave oven 20 to be spaced apart by a predetermined distance in a vertical direction. At this time, since the microwave oven 20 is generally used as a combination hood and microwave oven, it is configured to have a function of discharging fumes, heat and the like generated from the gas cooking stove G although it is not shown in the figure.

The bottom plate 12 of the kitchen furniture 10 on which the microwave oven 20 is installed is formed with through-holes 14 through which the cords 30 can pass. The stopper 40 is installed in the through-hole 14.

Figure 3:
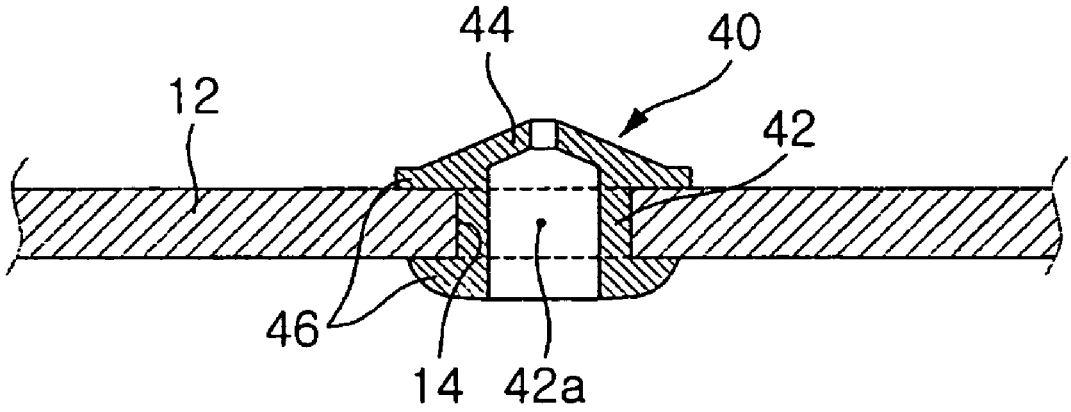
FIG. 3 is a sectional view showing the configuration of a stopper according to an embodiment of the present invention.
Figure 4A:
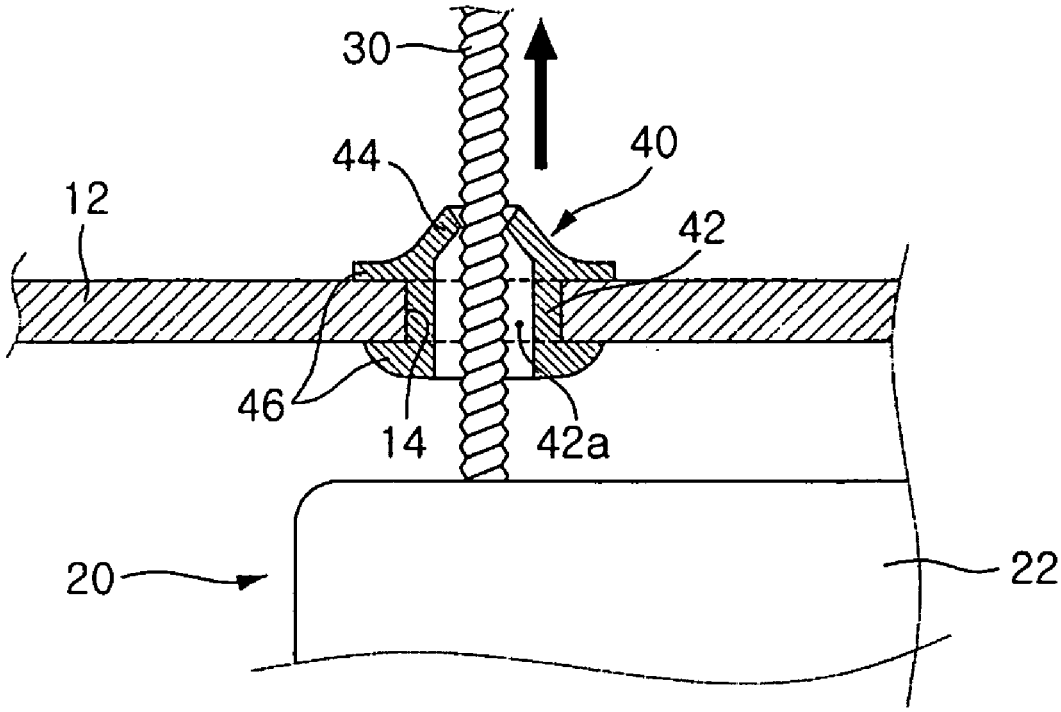
FIG. 4*a* is a sectional view showing a lifted state of a rope according to an embodiment of the present invention.
Figure 4B:
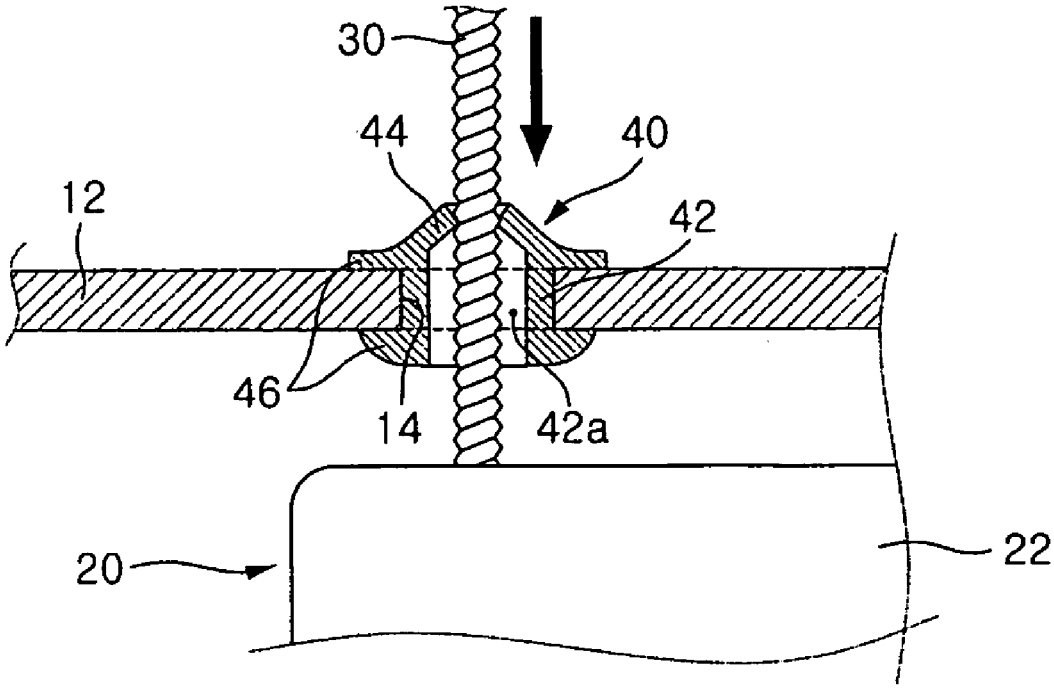
FIG. 4*b* is a sectional view showing a lowered state of the rope according to an embodiment of the present invention.

The stopper 40 serves to allow the aforementioned cord 30 to be lifted upwardly but not to be inadvertently lowered so as to maintain a stopped state of the cord. FIGS. 3, 4*a* and 4*b* show the stopper 40 of the present invention.

The stopper according to the preferred embodiment of the present invention will be described in detail with reference to FIGS. 3, 4*a* and 4*b*.

As shown in FIG. 3, the stopper 40 includes a stopper body 42, a catching piece 44 and support portions 46. Here, the stopper body 42 is inserted into the through-hole 14 of the kitchen furniture 10 and formed with a center hole 42*a* through which the cord 30 can pass.

Further, the catching piece 44 upwardly inclined to narrow toward a central axis of the center hole is formed on a position corresponding to an upper end of the center hole 42*a*. The diameter of the center hole 42*a* defined at the catching piece 44 is designed to be relatively smaller than that of the cord 30 such that the catching piece 44 is elastically deformed and thus brought into close contact with the cord 30 when the cord 30 has passed through the catching piece 44 via the center hole 42*a*.

Since the catching piece 44 is upwardly inclined to narrow toward the central axis of the center hole, it can be elastically deformed in an upward direction to limit a one-way motion of the cord 30 that has passed through the center hole 42*a* at the center portion of the catching piece 44.

That is, as shown in FIG. 4*a*, the cord 30 can smoothly move through the center hole 42*a* at the center portion of the catching piece 44 when it moves upwardly. However, if the cord 30 is to move downwardly, an outer periphery of the cord 30 is brought into contact with an inner end of the catching piece 44 to substantially limit the downward motion of the cord 30. In other words, the catching piece 44 of the stopper 40 according to this embodiment of the present invention, which is upwardly inclined to narrow toward a central axis of the stopper, allows the cord 30 to be lifted upwardly but limits the downward motion of the cord 30.

Further, the support portions 46, which bring the stopper body 42 into close contact with top and bottom surfaces of the bottom plate 12 of the kitchen furniture 10, respectively, are provided on the stopper body 42. Although it has been illustrated in this embodiment that the stopper body 42 is integrally formed with the support portions 46, but the present invention is not limited thereto. That is, the support portions 46 can support the stopper body 42 in such a manner that male and female threads are formed on the upper and lower outer peripheries of the stopper body 42 and the inner peripheries of the support portions 46, respectively, such that the male and female threads are engaged with each other.

If the support portions 46 are integrally formed on the stopper body 42, it is preferred that the support portions can be elastically deformed to a certain extent. The reason is that some of the support portions 46 can pass through the through-hole 14 when the stopper is mounted to the bottom plate 12 of the kitchen furniture 10.

The stopper 40 configured as above is used in the following manner. That is, the microwave oven 20 can be lift to a desired position by pulling up the cord 30 fastened to the top plate 22 of the microwave oven 20 as shown in FIG. 2. However, if the cord 30 is released in such a state, the downward force is exerted due to the weight of the microwave oven 20, but the outer periphery of the cord 30 is caught in the catching piece 44 such that the microwave oven 20 can be kept at a certain position. That is, the microwave oven 20 can be kept at an elevated level with a certain height.

In addition, the stopper 40 is kept at a state where it is fixed to the bottom plate 12 while withstanding the pulling force of an operator and the weight of the microwave oven 20, by means of the support portions 46 of the stopper body 42, when the cord 30 is pulled up in a vertical direction.

At a position where the microwave oven 20 is lifted upwardly to a desired height in such a manner, the microwave oven 20 is coupled with the mounting plate (not shown) by fastening and fixing a rear plate (not shown) of the microwave oven to the mounting plate installed on a wall surface opposite to the rear plate of the microwave oven. The microwave oven 20 can be substantially installed below the kitchen furniture 10 by fastening the top plate 22 of the microwave oven 20 to the bottom plate 12 of the kitchen furniture 10 using long screws (not shown) at the coupled position.

That is, it is understood from the present invention that the microwave oven 20 can be easily lifted to a desired position. It is also understood that the microwave oven 20 can be conveniently fastened to the mounting plate at a state where it is lifted to the desired position and then be fastened to the bottom plate 12 of the kitchen furniture 10 using the screws.

Next, a stopper according to a second embodiment of the present invention will be described with reference to FIGS. 5, 6*a* and 6*b*.

Figure 5:
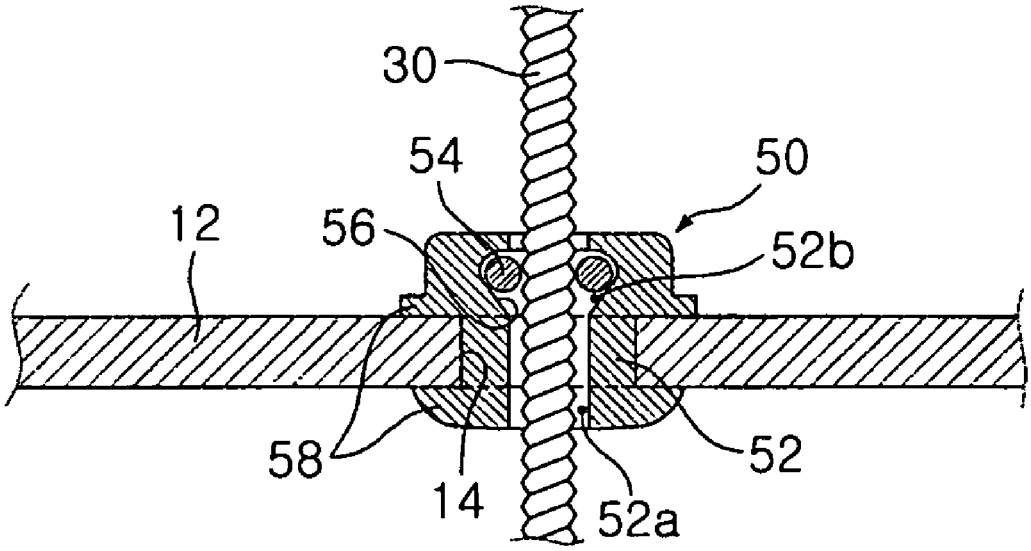
FIG. 5 is a sectional view showing the configuration of a stopper according to another embodiment of the present invention.

The stopper 50 of the second embodiment shown in FIG. 5 is inserted into the through-hole 14 formed in the bottom plate 12 of the kitchen furniture 10 (See FIG. 2).

The stopper 50 includes a stopper body 52, balls 54, an inclined surface 56 and support portions 58. Here, the stopper body 52 is inserted into the through-hole 14. Further, a center hole 52*a* through which the cord 30 can freely pass is formed in a vertical direction along a central portion of the stopper body 52. Furthermore, an internal space 52*b*, which is expanded in a radial direction, is also formed at a predetermined position (preferably, at an upper side) of the center hole 52*a*.

The inwardly narrowing inclined surface 56 is provided around a lower part of the internal space 52*b*. That is, the inclined surface 56 in the internal space 52*b* is formed to narrow downwardly along the internal space. Further, a plurality of balls 54 are inserted into the internal space 52*b* such that they can move within a space defined between the internal space 52*b* and the cord 30 passing through the internal space.

In addition, the support portions 58, which bring the stopper body 52 into close contact with the top and bottom surfaces of the bottom plate 12 of the kitchen furniture 10, respectively, are provided on the stopper body 52. Since the support portions 58 have the same function as the support portions 46 of the first embodiment, the detailed descriptions thereof will be omitted from the second embodiment.

Hereinafter, the operation of the stopper according to this embodiment will be explained.

Figure 6A:
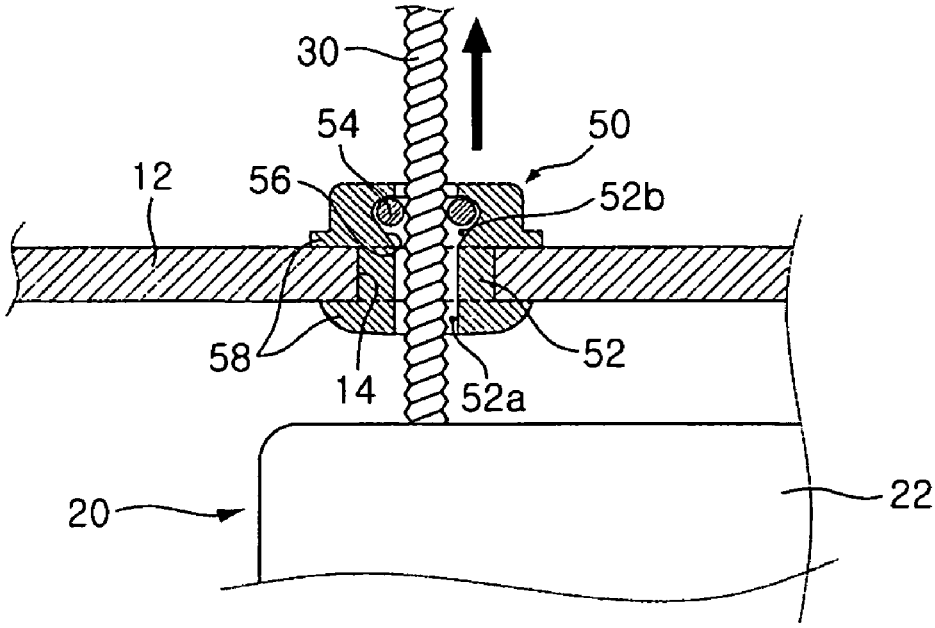
FIG. 6*a* is a sectional view showing a lifted state of a rope according to another embodiment of the present invention.

FIG. 6*a* shows a state where the cord 30 is pulled up in a vertical direction. As shown in the figure, when the cord 30 is pulled up, the balls 54 can be sufficiently moved outwardly into the internal space 52*b*, and thus, the cord 30 can be easily moved upwardly.

Figure 6B:
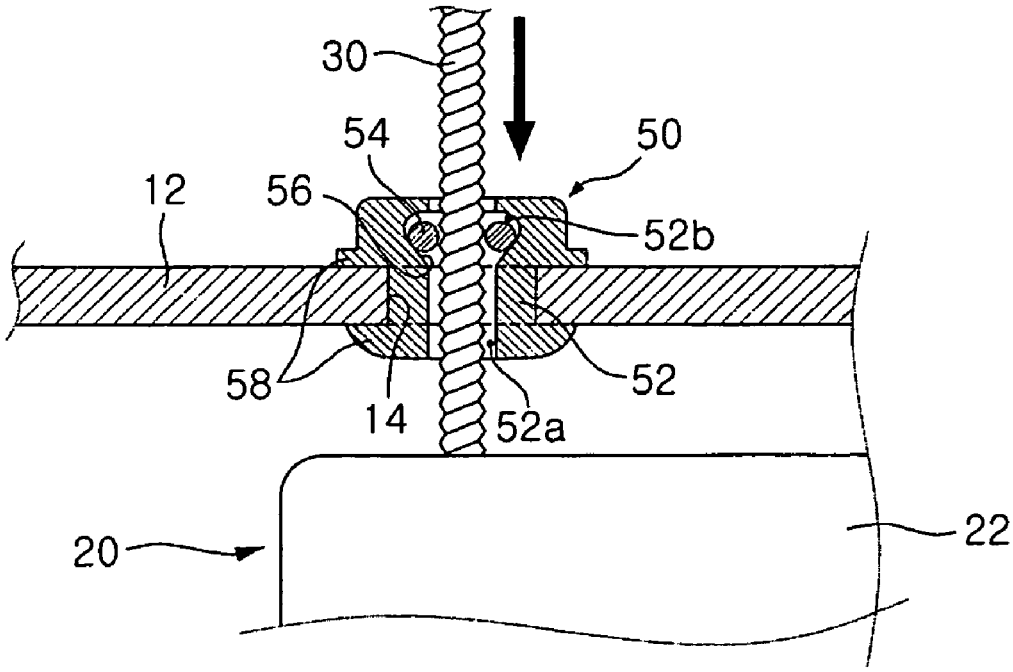
FIG. 6*b* is a sectional view showing a lowered state of the rope according to another embodiment of the present invention.

As shown in FIG. 6*b*, however, if the cord 30 is to move downwardly, the balls 54 move downwardly into a lower portion of the internal space 52*b* due to their own weight. When the balls 54 are moved downwardly into the lower portion of the internal space 52*b* and then positioned on the inclined surface 56, a predetermined friction force is generated between the balls 54 and the cord 30. Therefore, since this friction force causes the balls 54 to be caught between the cord 30 and the inclined surface 56 and thus their rotation and downward motion to be limited even though the cord 30 is intended to move downwardly, the downward motion of the cord 30 will be substantially limited.

At this time, the stopper 50 is kept at a state where it is fixed to the bottom plate 12 while withstanding the pulling force of an operator and the weight of the microwave oven 20, by means of the support portions 58 of the stopper body 52, when the cord 30 is pulled up in a vertical direction.

It is understood that the cord 30 can be freely pulled up but cannot be lowered due to the stoppers 40 and 50 of the first and second embodiments. This means that the microwave oven 20 can be moved upwardly and then kept at a predetermined position due to the above operation.

In addition, FIG. 7 shows an embodiment in which the cord is fixed in the microwave oven. As shown in the figure, the cord 30 is inserted in the microwave oven 20 through a hole 23 formed in the top plate 22 of the microwave oven 20. Further, a holder 32, which is larger than the area of the hole 23 formed in the top plate 22, is attached to a lower end of the cord 30. Therefore, since the cord 30 can be supported on the bottom surface of the top plate 22 around the hole 23 by means of the holder 32 attached to the lower end of the cord 30, the microwave oven 20 can be substantially lifted upwardly using the cord 30. At this time, to reinforce the strength of the top plate 22 of the microwave oven 20, a reinforcing plate 24 may be installed on the bottom surface of the top plate 22 around the hole 23.

The method of fixing the cord 30 may be applied to the first and second embodiments of the present invention without any changes. In other words, as shown in FIG. 2, when the cords 30 extending outwardly through the hole 23 of the top plate 22 of the microwave oven 20 are pulled up, the microwave oven 20 can be lifted to a desired position since the holder 32 supports or upholds the bottom surface of the top plate 22 of the microwave oven 20.

If the cord 30 is released in such a state, the downward force is exerted due to the weight of the microwave oven 20. However, the cord 30 can be lowered no longer since the outer periphery of the cord 30 is caught in the catching piece 44 as shown in FIG. 4*b* or the friction force is generated between the outer periphery of the cord 30 and the balls 54 in the stopper 50. Therefore, the microwave oven 20 can be kept at an elevated level.

Furthermore, since the stopper bodies 42 and 52 are provided with the support portions 46 and 58, respectively, the stoppers 40 and 50 can maintain its own state where they are fixed to the bottom plate 12 even though the weight of the microwave oven 20 is exerted on the stoppers 40 and 50.

At a position where the microwave oven 20 is lifted upwardly to a desired height in such a manner, the microwave oven 20 is coupled with the mounting plate (not shown) by fastening and fixing the rear plate (not shown) of the microwave oven to the mounting plate installed on the wall surface opposite to the rear plate of the microwave oven. The microwave oven 20 can be substantially installed below the kitchen furniture 10 by fastening the top plate 22 of the microwave oven 20 to the bottom plate 12 of the kitchen furniture 10 using the long screws (not shown) at the coupled position.

According to the present invention described above, the microwave oven can be easily lifted to the bottom surface of the kitchen furniture. Further, even a single operator can easily lift the microwave oven to a desired position by using the lifting device of the present invention.

According to the present invention described above, the following advantageous effects will be expected.

Heretofore, two persons should perform the operation of lifting the microwave oven to a desired position so as to install the microwave oven to the desired position below the kitchen furniture. However, the microwave oven can be easily lifted to a position right below the kitchen furniture by using the cords and stoppers according to the present invention. Therefore, the advantage in that the microwave oven can be very conveniently installed is expected.

It will be apparent that those skilled in the art can make various modifications and changes within the scope of the fundamental technical spirit of the present invention. Accordingly, the scope of the present invention should be construed on the basis of the appended claims.

What is claimed is:

1. A device for lifting a microwave oven installed at a position right below kitchen furniture, comprising:

a cord having an end fixed in a microwave oven and extending outwardly from the microwave oven through a hole formed in any one of external plates of the microwave oven; and a stopper installed in a through-hole formed in a bottom plate of the kitchen furniture to limit a one-way motion of the cord passing through the stopper when the cord has passed through the through-hole.

2. The device as claimed in claim 1, wherein the cord is uneven on an outer periphery thereof to increase a contact area with the stopper.

3. The device as claimed in claim 2, wherein the cord is a rope.

4. The device as claimed in claim 1, wherein the cord is inserted in a hole formed in a top plate of the microwave oven and an lower end of the cord is attached to a holder having an area relatively larger than the hole such that the microwave oven can be lifted up by causing the holder to be supported on a bottom surface of the top plate.

5. The device as claimed in claim 1, wherein the stopper includes:

a stopper body inserted in the through-hole and formed with a center hole through which the cord can pass; and a catching piece extending upwardly from the stopper body to narrow toward a central axis of the center hole such that the catching piece is caught in the outer periphery of the cord to limit the downward motion of the cord.

6. The device as claimed in claim 5, wherein the stopper further includes support portions which are provided on the stopper body to bring the stopper body into close contact with the bottom plate of the kitchen furniture.

7. The device as claimed in claim 1, wherein the stopper include:

a stopper body inserted in the through-hole and formed with a center hole through which the cord can pass and an internal space which is defined at and expanded at a predetermined position in a radial direction;

a plurality of balls disposed around the cord within the internal space; and an inclined surface defined in a lower portion of the internal space to be inclined downwardly toward the center of the center hole, and wherein a friction force is generated between the cord and the balls when the cord is moved downwardly, and downward motions of the balls is limited by means of the cord and the inclined surface such that the downward motion of the cord is limited with respect to the stopper.

8. The device as claimed in claim 7, wherein the stopper further includes support portions which are provided on the stopper body to bring the stopper body into close contact with the bottom plate of the kitchen furniture.

9. A lifting device for a microwave oven installed at a position right below kitchen furniture, comprising:

a rope having an end fixed in a microwave oven and extending outwardly from the microwave oven through a hole formed in an external top plate of the microwave oven; and a stopper installed in a through-hole formed in a bottom plate of the kitchen furniture and formed with a center hole, through which the rope passes, to allow the rope to be lifted upwardly but to limit a downward motion of the rope when the rope has passed through the center hole.

* * * * *